United States Patent [19]

Kuhnke et al.

[11] Patent Number: 4,500,449

[45] Date of Patent: Feb. 19, 1985

[54] METHOD FOR SOLIDIFYING BORON-CONTAINING RADIOACTIVE RESIDUES

[75] Inventors: Klaus Kuhnke; Dietmar Bege, both of Erlangen; Anwer Puthawala, Erlangen-Buckenhof; Günter Wittrowsky, Erlangen, all of Fed. Rep. of Germany

[73] Assignee: Kraftwerk Union Aktiengesellschaft, Mülheim, Fed. Rep. of Germany

[21] Appl. No.: 371,125

[22] Filed: Apr. 23, 1982

Related U.S. Application Data

[63] Continuation of Ser. No. 123,445, Feb. 21, 1980, abandoned.

[30] Foreign Application Priority Data

Mar. 19, 1979 [DE] Fed. Rep. of Germany ..... 2910677

[51] Int. Cl.[3] ..... G21F 9/16

[52] U.S. Cl. ..... 252/628; 252/631; 252/632

[58] Field of Search ..... 252/628, 632, 631

[56] References Cited

U.S. PATENT DOCUMENTS

| | | | |
|---|---|---|---|
| 3,507,801 | 4/1970 | Kausz et al. | 252/628 |
| 3,971,732 | 7/1976 | Meier | 252/628 |
| 3,988,258 | 10/1976 | Curtiss et al. | 252/628 |
| 4,086,325 | 4/1978 | Cordier | 252/628 |
| 4,253,985 | 3/1981 | Filter | 252/628 |

FOREIGN PATENT DOCUMENTS

| | | |
|---|---|---|
| 2553569 | 6/1977 | Fed. Rep. of Germany . |
| 49-104100 | 10/1974 | Japan . |
| 1557261 | 12/1979 | United Kingdom . |

*Primary Examiner*—Deborah L. Kyle

*Attorney, Agent, or Firm*—Herbert L. Lerner; Laurence A. Greenberg

[57] ABSTRACT

Solidifying radioactive liquid concentrate residues containing borates by embedding in a binder by mixing. Prior to embedding, sodium hydroxide is added to the waste concentrate to obtain a mole ratio of sodium to boron of 0.25 with a corresponding pH value in the range of 7.3 to 8.0 or 0.7 with a corresponding pH value of 9.8 to 10.2. The waste concentrate with added sodium hydroxide is mixed with a binder to embed it into the binder.

2 Claims, No Drawings

METHOD FOR SOLIDIFYING BORON-CONTAINING RADIOACTIVE RESIDUES

This is a continuation of application Ser. No. 123,445, filed Feb. 21, 1980, now abandoned.

BACKGROUND OF THE INVENTION

1. Field of the Invention

The invention relates to a method for solidifying radioactive residues from liquid waste of pressurized-water reactors which are also called concentrates and usually comprise boron in the form of borates.

2. Description of the Prior Art

It is known to solidify such concentrates by embedding them in binders by means of a mixing device. Worm dryers such as shown in German Published Prosecuted Application No. 22 40 119 are used, among others, as a mixing device. Bitumen is used particularly as the binder. However, the binder may also include plastics, for instance, polyethylene, as well as concrete or the like.

The residues to be embedded, which are usually concentrated by evaporation but are still liquid, are frequently accumulated over an extended period of time before they are present in an amount worthwhile for embedding. For this purpose, shielded containers are provided which, because of the radioactivity, are practically inaccessible. In this connection no disturbances must occur to the concentrate, for instance, through crystallization of boron compounds in the concentrate. Further difficulties in embedding the mentioned radioactive residues can result from the fact that the residues crystallize in being embedded. Extremely hard crystals can be produced in this connection so that, at a minimum, heavy abrasion results in the mixer used for the embedment with a greater danger of the hard crystalline solids blocking the mixing device. The water vapor and volatility of boron compounds can furthermore lead to incrustation at steam-carrying internals of the mixing apparatus under certain conditions. A further aggravating disadvantage of conventional embedment methods is that the end products have only low leaching resistance.

SUMMARY OF THE INVENTION

It is an object of the invention to provide an improved method of conditioning liquid concentrates of boron-containing radioactive residues to be solidified by embedment in a binder such that storage and embedment can be carried cut in an optimum manner, optimum meaning, among other things, that the amount of residue relative to the amount of binder is maximized.

With the foregoing and other objects in view there is provided in accordance with the invention a method for solidifying radioactive liquid concentrate residues from liquid wastes of pressurized-water reactors containing boron in the form of borates by embedding the residues in a binder by mixing in a mixing device, the improvement comprising prior to said embedding in a binder, adding sodium hydroxide to the waste concentrate to obtain a mole ratio of sodium to boron of about 0.25 or 0.7 with a respective corresponding pH value in the range of 7.3 to 8.0 or 9.8 to 10.2 and mixing the waste concentrate to which sodium hydroxide has been added with a binder to embed the waste concentrate in the binder.

Other features which are considered as characteristic for the invention are set forth in the appended claims.

Although the invention is illustrated and described herein as embodied in a method for solidifying boron-containing radioactive residues, it is nevertheless not intended to be limited to the details shown, since various modifications may be made therein without departing from the spirit of the invention and within the scope and range of equivalents of the claims.

DETAILED DESCRIPTION OF THE INVENTION

In the method according to the invention a mole ratio of sodium to boron of either 0.25 or 0.7 is set by adding sodium hydroxide to the residues, corresponding to a pH-value ranges of 7.3 to 8.0 for a mole ratio of 0.25, and 9.8 to 10.2 for a mole ratio of 0.7. For, it has been found that, contrary to the embedment conditions up to now, for instance, with a mole ratio of about 1, the following disadvantages are avoided with the mole ratios according to the invention:

The resistance of the bitumen to strong caustic solutions is relatively poor. Therefore, the leaching resistance of the end product (bitumen with embedded residues) is improved substantially by the invention because of the smaller amount of caustic solution.

In addition, because of the reduced requirement for sodium hydroxide, the mole ratio according to the invention results in a reduction of up to 50% in waste volume.

The composition of the embedded borates is substantially less aggressive, i.e. reactive with respect to the bitumen, so that the danger of liberation of flammable vapors, previously observed, is practically completely avoided.

The maximum embedment quantity of the residues is obtained with a mole ratio of 0.7. There, in accordance with a further feature of the invention, the processing and storage are carried out at temperatures of at least 50° C. and preferably 80° C. in order to avoid crystallization, which occurs for this mole ratio at lower temperatures. Of course, unduly high temperatures such as would cause evaporation of the concentrate in storage should not be employed. For this purpose the containers used for storing the residues can be provided with heating means such as a steam jacket or coil, so that the heating to the above-mentioned temperatures can be carried out not later than when the sodium hydroxide is added in accordance with the invention.

With the above-mentioned mole ratio of sodium to boron of 0.7, the pH value is between 9.8 and 10.2 at 20° C.

The solubility of the borate is 125 g boron/kg at 80° C. and about 5 g boron/kg bitumen at 20° C. The solids produced during the embedding in bitumen have approximately the following composition:

$$2Na_2O \times 3B_2O_3 \times 4H_2O.$$

These solids are present in the form of a melt at the operating temperatures of the worm dryer used as the mixing apparatus, so that abrasion and salt incrustation in suction lines associated with the mixing device are minimized. Also the leaching resistance of the end product is very favorable because of the low solubility of these borates at low temperatures.

With a mole ratio of sodium to boron of 0.25, on the other hand, the processing and storage temperature can be in the range of room temperatures. For this ratio, a pH-value of 7.3 to 8.0 is obtained at 20° C. The solubility of the borates is about 100 g boron/kg at 80° C. and 20 g boron/kg at 20° C. The solids have the composition:

$$Na_2O \times 4B_2O_3 \times 4H_2O.$$

Operating with a sodium-boron mole ratio of 0.25 prevents any salt encrustation in exhaust domes and lines and reduces the wear of the dryer worms. The leaching resistance of the end products is good. The pH-value of the bound solids of about 7.5 would seem to ensure the leaching resistance even after extended periods of storage. For adjusting the sodium-boron mole ratio of 0.25, only small amounts of sodium hydroxide are required. An advantage is that the storage of the residues can be carried out at temperatures of 20° C.

There are claimed:

1. Method for the treatment of radioactive concentrates from liquid wastes containing boron of pressurized water reactors, for storage and mixing with a binding agent, which comprises adding sodium hydroxide to said radioactive waste concentrate containing boron to obtain a mole ratio of sodium to boron of about 0.7 with a corresponding pH value in the range of 9.8 to 10.2 to produce a reaction product having approximately the following composition: $2Na_2O \times 3B_2O_3 \times 4H_2O$, said reaction product characterized by being in the molten phase at a temperature within the range of 50° C. to below the temperature at which the concentrate would evaporate, and maintaining the mixture of radioactive waste concentrate containing boron and sodium hydroxide at a temperature of at least 50° C. but below the temperature at which the concentrate would evaporate during said reaction of sodium hydroxide with the radioactive waste and during holding-time prior to mixing with a binding agent to prevent crystallization of boron compounds in the mixture, without further chemical treatment to chemically alter the boron compounds and without prior drying the mixture to cause crystallization of the boron compounds to retain them in the liquid state, and subsequently introducing the mixture into a worm mixing device maintained at an elevated temperature in which the reaction product retains its liquid state upon contacting and mixing with a binding agent also introduced into the worm mixer.

2. Method according to claim 1, wherein the binding agent is bitumen.

* * * * *